US008991413B2

(12) United States Patent
Arbeiter et al.

(10) Patent No.: US 8,991,413 B2
(45) Date of Patent: Mar. 31, 2015

(54) CANOPY TENSIONING APPARATUS

(71) Applicant: Ultra Play Systems, Inc., Red Bud, IL (US)

(72) Inventors: Jacob Arbeiter, Ruma, IL (US); Jon Lawrence, Waterloo, IL (US)

(73) Assignee: Ultra Play Systems, Inc., Red Bud, IL (US)

( * ) Notice: Subject to any disclaimer, the term of this patent is extended or adjusted under 35 U.S.C. 154(b) by 0 days.

(21) Appl. No.: 13/798,621

(22) Filed: Mar. 13, 2013

(65) Prior Publication Data

US 2014/0261599 A1 Sep. 18, 2014

(51) Int. Cl.
*E04H 15/64* (2006.01)

(52) U.S. Cl.
CPC ..... *E04H 15/64* (2013.01)
USPC ..... 135/123; 135/147; 135/119

(58) Field of Classification Search
USPC ..... 135/121–123, 119, 907, 141–142, 161, 135/120.2; 160/378, 328–329; 242/388.2; 211/119.15
See application file for complete search history.

(56) References Cited

U.S. PATENT DOCUMENTS

| | | | | |
|---|---|---|---|---|
| 1,962,916 | A * | 6/1934 | Smith | 135/99 |
| 2,928,403 | A * | 3/1960 | Hoskins | 135/142 |
| 4,726,153 | A * | 2/1988 | Adler et al. | 52/63 |
| 5,131,115 | A * | 7/1992 | Sarto | 16/82 |
| 6,616,211 | B2 | 9/2003 | Cramaro | |
| 6,691,723 | B2 * | 2/2004 | Godbersen | 135/123 |
| 6,814,094 | B1 * | 11/2004 | Barber | 135/119 |
| 6,874,518 | B2 * | 4/2005 | Porter | 135/124 |
| 7,025,074 | B2 | 4/2006 | Porter | |
| 7,219,681 | B1 * | 5/2007 | Hamilton-Jones | 135/123 |
| 7,392,816 | B2 | 7/2008 | Porter et al. | |
| 7,516,577 | B1 | 4/2009 | Ranieri | |
| 7,757,439 | B1 | 7/2010 | Ranieri | |
| 7,766,024 | B2 | 8/2010 | Rottmann | |
| 7,798,553 | B2 | 9/2010 | Beshiri et al. | |
| 7,814,921 | B1 | 10/2010 | Ranieri | |
| 8,215,326 | B2 * | 7/2012 | Park et al. | 135/145 |
| 2004/0025383 | A1 | 2/2004 | Milton | |
| 2005/0138869 | A1 * | 6/2005 | Porter | 52/79.1 |
| 2006/0174929 | A1 * | 8/2006 | Tseng | 135/159 |
| 2007/0028953 | A1 * | 2/2007 | Zanot | 135/119 |
| 2007/0240746 | A1 * | 10/2007 | Chen | 135/119 |
| 2009/0301534 | A1 | 12/2009 | Bettega et al. | |

FOREIGN PATENT DOCUMENTS

| | | | | |
|---|---|---|---|---|
| GB | 2153947 | A * | 8/1985 | F16B 43/00 |

* cited by examiner

*Primary Examiner* — Winnie Yip
(74) *Attorney, Agent, or Firm* — McAndrews, Held & Malloy, Ltd.

(57) ABSTRACT

A tensioning apparatus for a fabric covered canopy is disclosed. The tensioning apparatus is supported on a vertical post and is connected to a roof support beam. A hook is mounted to the tensioning apparatus and may be reciprocally moved along the longitudinal axis of the tensioning apparatus for adjustment of the tension of the fabric top of canopy.

16 Claims, 3 Drawing Sheets

CANOPY TENSIONING APPARATUS

FIELD OF THE INVENTION

This application relates to building structures and more particularly to canopies having a fabric stretched over a framework, and still more particularly to a tensioning apparatus for maintaining the fabric in a stretched condition.

BACKGROUND OF THE INVENTION

Building structures such as fabric canopies are generally used as sunshades in playgrounds, parks and the like. To install and maintain fabric canopies, it is desirable that a tensioning apparatus be a part of the structure, and further, that the tensioning apparatus be easy to install and adjust, requiring no special tools or dismantling of the structure during adjustment. In the past, a come-along, i.e. a hand operated lever winch, has been used to tension the fabric. However, a come-along, in addition to being somewhat hard to use, is also obtrusive and unsightly.

It is therefore a benefit of the subject invention to have an adjustable and easily installed fabric canopy.

It is further benefit of the subject invention to have a tensioning apparatus for use with a fabric canopy.

A still further benefit of the subject invention is a tensioning apparatus that can be adjusted without special tools.

SUMMARY OF THE INVENTION

The subject invention, in one aspect, includes a tensioning apparatus for a fabric canopy that is supported on a vertical upright. The vertical upright is one of the supports for the fabric canopy. The tensioning apparatus includes a longitudinally movable hook that catches an eyelet, loop, or other opening in the fabric and can, by movement of the hook along the longitudinal axis of the tensioning apparatus, either tighten or loosen the tension of the fabric canopy as needed. The hook is located in an open longitudinal slot in the tensioning apparatus and extends to within the tensioning apparatus, being secured to a threaded nut on a threaded shaft. The threaded shaft is secured for rotation at either end so that upon rotation of the shaft, the hook moves longitudinally, for an adjustment of the tension of the fabric.

These, and other aspects of the subject invention can be better understood and appreciated in conjunction with the accompanying drawings.

CONCISE DESCRIPTION OF THE DRAWINGS

DETAILED DESCRIPTION OF ONE EMBODIMENT OF THE INVENTION

Figure 1:
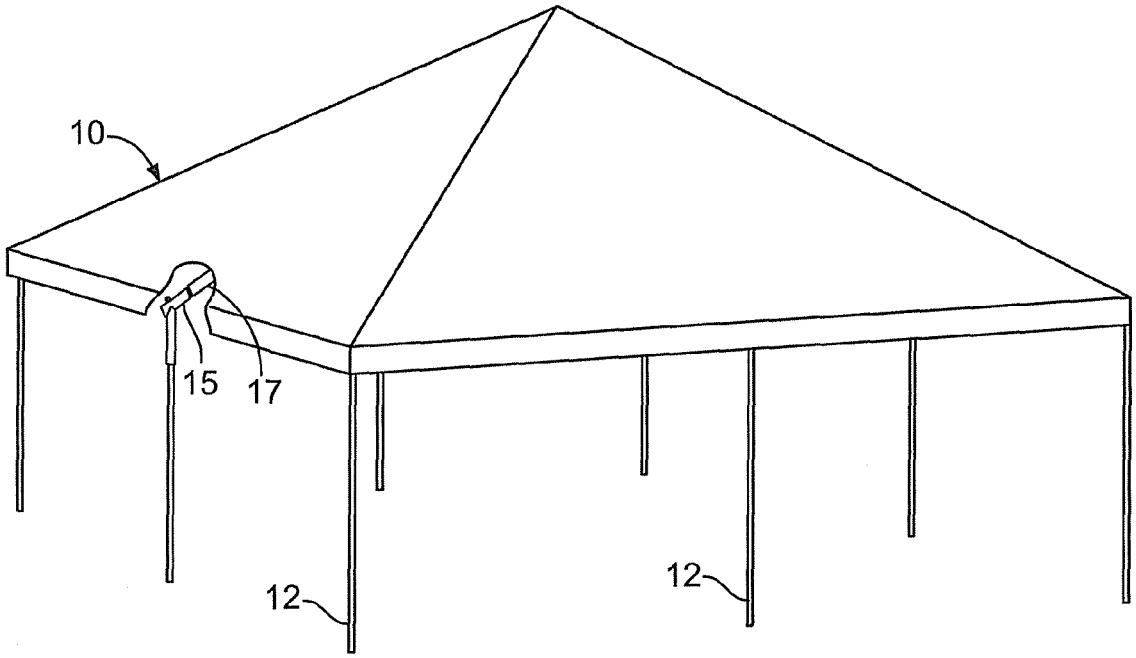
FIG. 1 is a perspective view of an embodiment of the subject invention showing its use with a fabric canopy.
Figure 3:
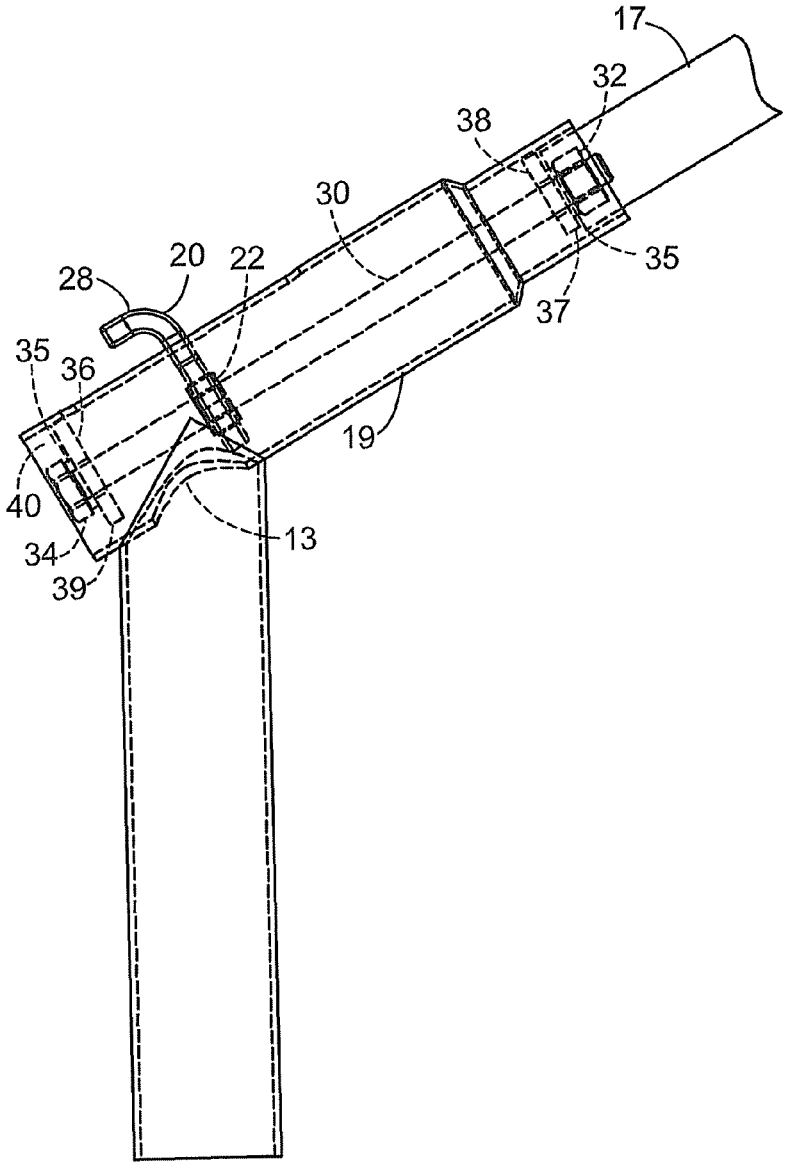
FIG. 3 is a side view of the embodiment of the subject invention of FIG. 2 with the interior shown in broken lines.
Figure 5:
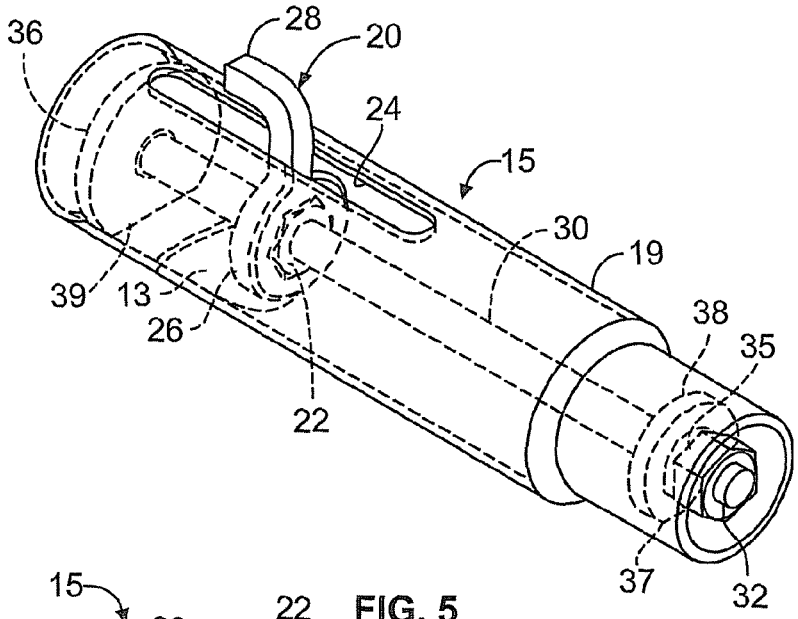
FIG. 5 is a perspective view of the embodiment of the subject invention of FIG. 2 with the interior shown in broken lines.
Figure 6:
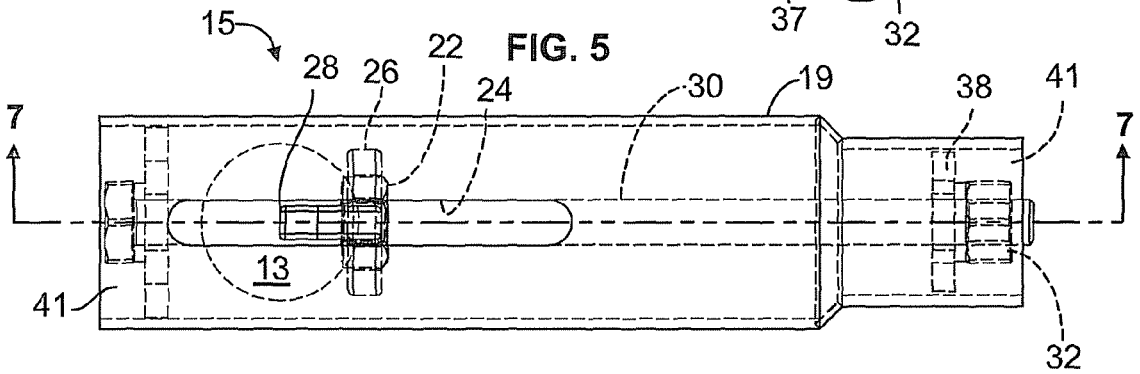
FIG. 6 is a side view of the embodiment of the subject invention of FIG. 2 with the interior shown in broken lines.

With respect to FIG. 1 there is shown a fabric canopy 10 utilizing the subject inventive cylindrical tensioning apparatus 15. The fabric canopy is formed of a plurality of roof support beams 17 supported at one end by vertical support posts 12 and in the center by a center post (not shown). The tensioning apparatus is mounted on each vertical support post 12 (FIG. 3), or possibly only selected vertical support posts, as necessary. Vertical support post may have a metal upper portion which can be welded or otherwise fixedly secured to tensioning apparatus 15 at opening 13 (FIGS. 3, 5 and 6). The roof support beams 17 are mounted to the tensioning apparatus at an outward or distal end and to the canopy center post at the other end, to thereby support the canopy. The tensioning apparatus maintains the tautness of the fabric and helps keep it in a stretched condition. Any size and shape of canopy as well as any suitable fabric is intended for use with the subject invention.

Figure 2:
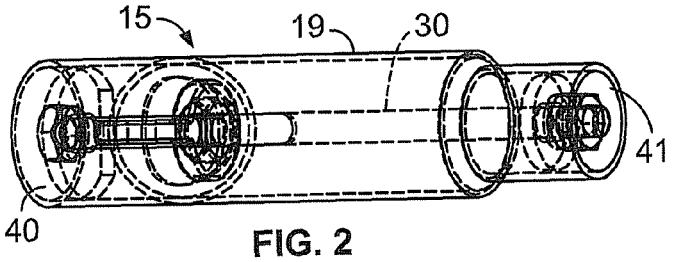
FIG. 2 is a perspective view of an embodiment of the subject invention with the interior shown in broken lines.

FIG. 2 shows the subject invention, with the interior in phantom. An interior shaft 30 is mounted by internal mounting plates 36 and 38 at each end respectively, the mounting plates generally conforming to and fixed to the interior of the cylindrical housing 19 with the exception of an open area 37, 39 at one end (FIG. 3). The mounting plates 36, 38 may thus take the shape of a round washer with a flat side 37, 39. The flat side of both mounting plates is positioned to be on a side of the cylinder 19 opposite that of the hook 20, to be described. Housing 19 is open at opposing ends 40 and 41; end 41 allows the connection and holding of a roof support beam 17, while end 40 allows engagement by a tool (to be discussed) with shaft 30. The roof support beam 17 is hollowed out at the outside or distal and to permit entry into opening 41 and permit engagement of the nut with a tool.

The interior shaft 30 is threaded at each end and at least through a portion of the center of the shaft. The shaft 30 may be threaded throughout its length, if desired.

The interior shaft has a hexagonal head 34 at an outside end and is secured in position by a nut, preferably, hexagonal, at a distal end outside mount 38. Washers 35 may be used. The outside end of the shaft is secured by a nut or other fastener 32. This nut 32 is held on the shaft so the nut rotates with the shaft does not loosen, and holds the shaft in place relative to housing 19.

Figure 4:
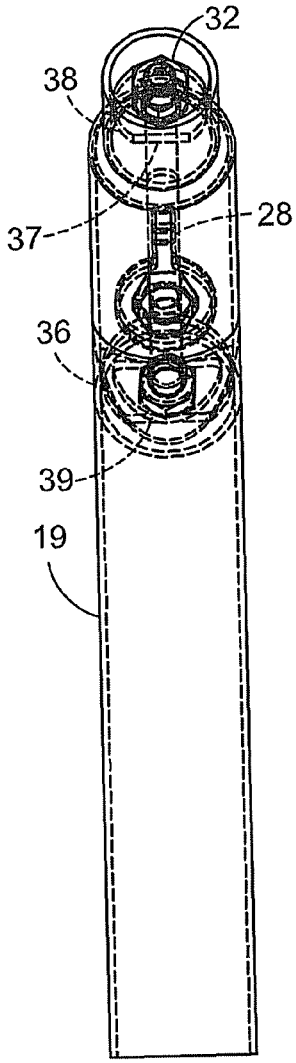
FIG. 4 is a front view of the embodiment of the subject invention of FIG. 2 with the interior shown in broken lines.

An elongated opening or slot 24, best shown in FIGS. 4 and 5 is shown formed in an outer portion of the apparatus housing 19, through it may be located on any portion of the housing. Through slot 24 a hook 20 with a bent outer portion 28 emerges. Hook 20 has an inner portion 26 that tightly and fixedly engages a nut, such as a hexagonal nut 22. Nut 22 is threadedly engaged with shaft 30 for travel along the shaft upon rotation of the shaft. The nut 22 need not be hexagonal, it can be any shape as long as it is fixed to the inner portion 26 of hook 20, so that the nut 22 travels along shaft 20 when the shaft is rotated.

The bent outer portion 28 of hook 20 has its distal end pointing to the outer end of the housing 19. Upon rotation of shaft 30, nut 22 and thus hook 20 are caused to move longitudinally along the axis of shaft 30 when the shaft is rotated.

In another embodiment hook 20 may be simply a straight post which is long enough to make it difficult for the eyelet or loop with which it is engaged to disengage.

Figure 7:
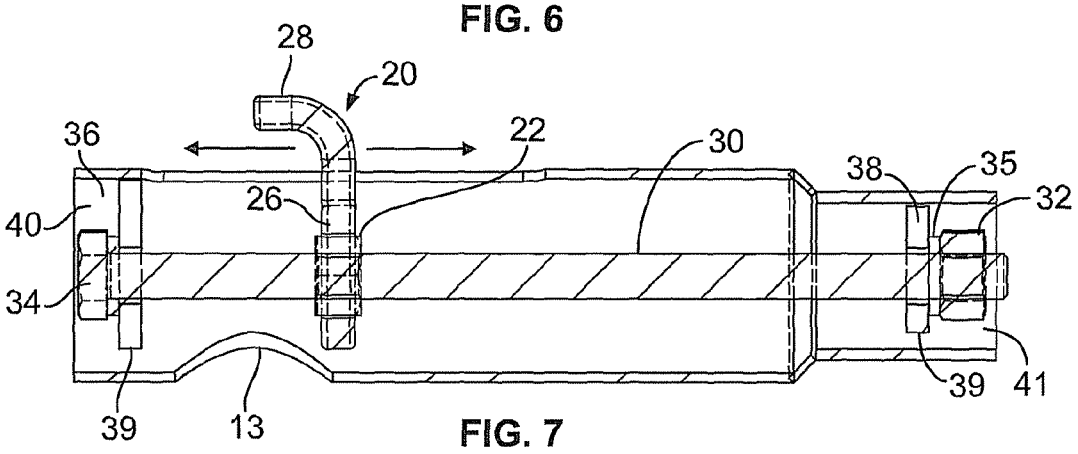
FIG. 7 is a cross sectional view of the embodiment of FIG. 2 taken along the lines 7-7 of FIG. 6.

The head of the shaft may have a shape, such as a hexagon or square which permits engagement with a tool, such as a socket or wrench, to manually rotate the shaft. A slotted head, a Phillip's head or other screw drive may also be used with a complimentary shaft head. Thus, by rotating the shaft, the hook 20 will move in a direction dictated by the direction of rotation of the shaft as shown by the arrows in FIG. 7.

As stated, mounts 36 and 38 have one flat side, and are oriented so that the flat side is on the bottom of the cylinder, opposite the hook, leaving an opening or passageway within the cylinder 19 for water to drain out.

In the use of the subject invention, the canopy is set up in the normal fashion, with a center vertical support post, which is connected to and supports roof support beams 17. Roof support beams are supported at an outer end with vertical support posts 12, which have the tensioning apparatus 15 secured at an upper end and supporting the distal end of the roof support beams 17. The fabric for the canopy is spread over the roof support beams, there are spaced, equidistant loops or eyelets at the periphery of the fabric, and the loops engage the hooks, which may then be moved in or out along the longitudinal axis of the tensioning apparatus 15 by rotating the shaft head 34. This action rotates the shaft 30 which moves the hook accordingly. When all loops are engaged with the respective hooks, it is a matter of tightening and loosening each canopy section as necessary through appropriate rotation of the shaft head 34 to achieve the right tensioning and placement of the canopy fabric.

It will be understood that the foregoing description is of preferred exemplary embodiments of the invention and that the invention is not limited to the specific forms shown or described herein. Various modifications may be made in the design, arrangement, and type of elements disclosed herein, as well as the steps of making and using the invention without departing from the scope of the invention as expressed in the appended claims.

We claim:

1. A tensioning apparatus for use with a fabric canopy, said tensioning apparatus being mounted on a vertical support pole and comprising:

a hollow cylinder, said cylinder having a longitundinal axis, and said cylinder being open at each end;

a threaded shaft within said cylinder;

a pair of spaced holder plates fixedly held within said cylinder, each of the holder plates being configured to leave a passageway within the cylinder for water to drain;

said shaft being held by said holder plates for rotation around the longitudinal axis;

an opening in said cylinder;

a post or hook extending through said opening and attached to said threaded shaft so that upon the rotation of said shaft, said post or hook travels along said longitundinal axis.

2. The tensioning apparatus of claim 1 wherein said holder plates are secured to an inside wall of said cylinder.

3. The tensioning apparatus of claim 1 where said post or hook is attached to said shaft by a fastening nut mounted for rotation on said shaft.

4. The tensioning apparatus of claim 1 wherein said opening is a longitudinal slot on said cylinder.

5. The tensioning apparatus of claim 1 wherein said threaded shaft comprises a bolt that passes through each of said holder plates.

6. The tensioning apparatus of claim 1 wherein said post or hook is adapted to catch an opening or loop in the fabric canopy.

7. The tensioning apparatus of claim 1 wherein said holder plates each comprise a disc having a flat side.

8. The tensioning apparatus of claim 7 wherein said flat side is on a lower side.

9. The tensioning apparatus of claim 1 wherein the shaft is capable of being rotated by at least one of a wrench, a socket wrench, and a screwdriver.

10. A canopy assembly having a framework covered by a fabric canopy, the framework comprising a plurality of roof support beams, a plurality of vertical support posts, and a plurality of tensioning apparatus;

each of said tensioning apparatus accepting an end of one of the roof support beams in a connective manner;

each of said tensioning apparatus being supported by a vertical support post; and each of said tensioning apparatus comprising a hollow cylinder having a longitudinal axis, said cylinder being open at each end;

a threaded shaft supported within said hollow cylinder by a pair of spaced holder plates for rotational movement around said longitudinal axis;

said holder plates each being secured to an interior wall of said hollow cylinder and each permitting a flow of fluid from one side to an opposite side;

a post or hook extending through an opening in a wall of said hollow cylinder and attached to said threaded shaft for reciprocal movement therealong; and said post or hook being securable to said fabric canopy for the tensioning and loosening of said fabric canopy by said reciprocal movement.

11. The canopy assembly of claim 10 wherein said holder plates each comprise a disc having a flat side.

12. The canopy assembly of claim 11 wherein said flat side is on a lower side.

13. The canopy assembly of claim 10 where said post or hook is attached to said shaft by a fastening nut mounted for rotation on said shaft.

14. The canopy assembly of claim 10 wherein said opening is a longitudinal slot on said cylinder.

15. The canopy assembly of claim 10 wherein said threaded shaft comprises a bolt that passes through each of said holder plates.

16. The canopy assembly of claim 10 wherein the shaft is capable of being rotated by at least one of a wrench, a socket wrench, and a screwdriver.

* * * * *